US006139095A

United States Patent [19]

Robertshaw

[11] Patent Number: 6,139,095

[45] Date of Patent: Oct. 31, 2000

[54] SPLIT SEAT PELVIC MOBILIZING CHAIR

[76] Inventor: Richard C. Robertshaw, 12255 Red Dog Rd., Nevada City, Calif. 95959

[21] Appl. No.: 09/223,869

[22] Filed: Dec. 31, 1998

[51] Int. Cl.[7] ..... A47C 13/00

[52] U.S. Cl. ..... 297/105; 297/312; 297/330

[58] Field of Search ..... 297/284.3, 312, 297/330, 423.41, 105, 217.1; 601/49, 50, 58, 60

[56] References Cited

U.S. PATENT DOCUMENTS

| | | | |
|---|---|---|---|
| 5,022,385 | 6/1991 | Harza . | |
| 5,024,485 | 6/1991 | Berg et al. | 297/312 |
| 5,314,238 | 5/1994 | Komorowski . | |
| 5,333,931 | 8/1994 | Weddendorf | 297/330 X |
| 5,580,128 | 12/1996 | Johnson et al. | 297/312 X |
| 5,588,704 | 12/1996 | Harza | 297/330 X |
| 5,709,363 | 1/1998 | Matsuhashi . | |
| 5,735,573 | 4/1998 | Vredevoogd . | |
| 5,751,129 | 5/1998 | Vergin . | |
| 5,913,568 | 6/1999 | Brightbill et al. | 297/312 X |
| 6,000,757 | 12/1999 | Sovis | 297/330 X |

*Primary Examiner*—Peter M. Cuomo
*Assistant Examiner*—Stephen Vu
*Attorney, Agent, or Firm*—Thomas M. Freiburger

[57] ABSTRACT

A split-seat chair includes a mechanism for stimulation of a person's hips while seated in the chair, by generally simulating the hip motion which occurs during walking, or by allowing such movement by the user. Two platforms under the respective buttocks of the person preferably move in orbital motions about a horizontal axis transverse to the chair, the two pads orbiting 180° out of phase relative to one another. The speed of orbital motion is preferably coordinated with the rate of circulation of cerebrospinal fluid in the skull as it travels down into the sacrum. The chair moves the pelvis in a gliding motion that partially mimics walking while the person is seated, thus reducing posturally caused lower back pain and stiffness.

8 Claims, 5 Drawing Sheets

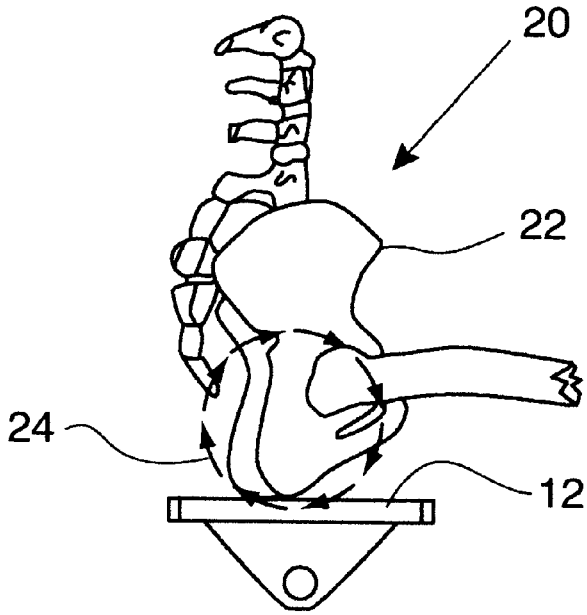
FIG. 2
FIG. 3
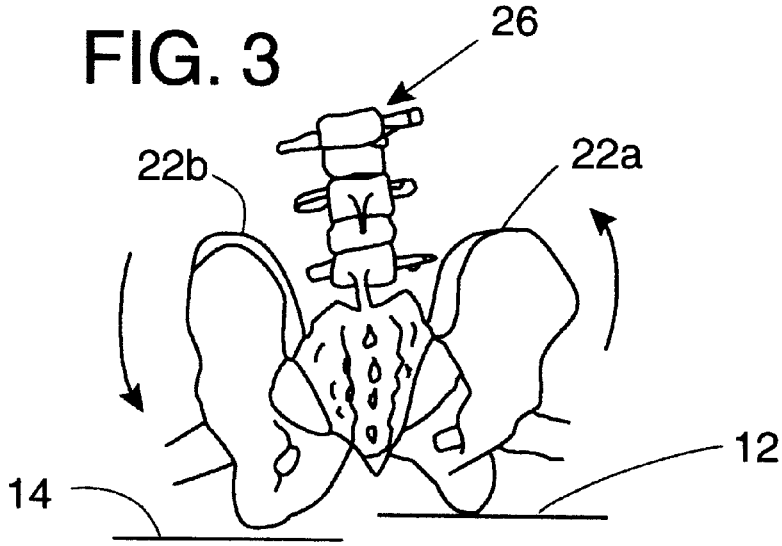

FIG. 8
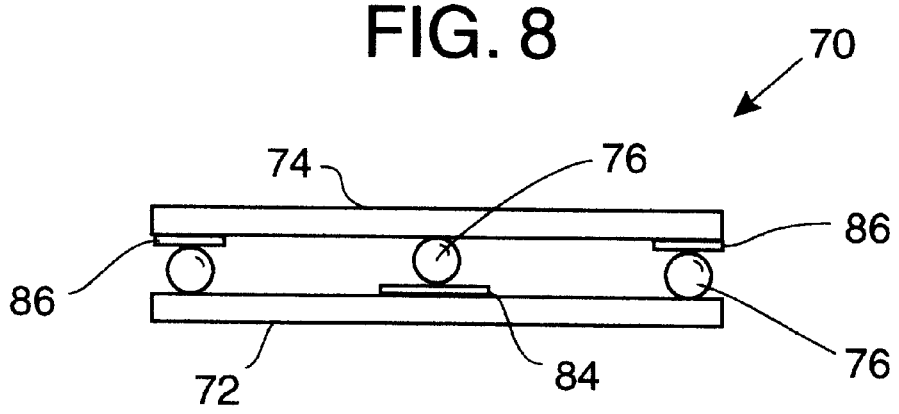
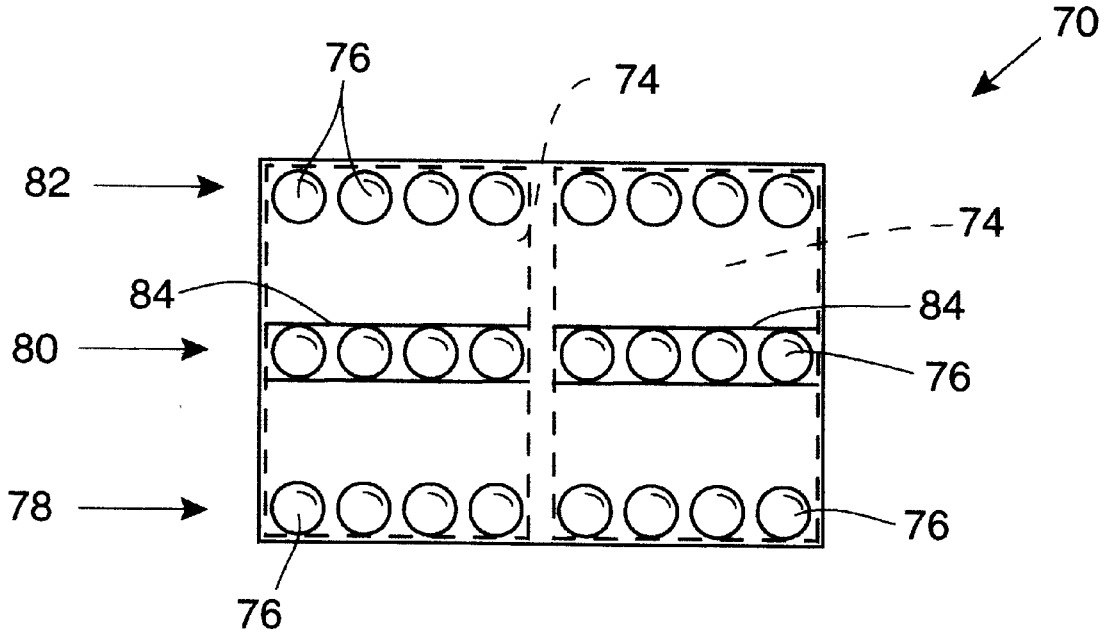
FIG. 9

SPLIT SEAT PELVIC MOBILIZING CHAIR

BACKGROUND OF THE INVENTION

This invention is concerned with an ergonomic chair which provides for stimulation of the hips while the user is seated, to at least partially simulate the hip motion involved in walking, thus reducing posturally caused lower back pain and stiffness.

Sitting for long hours, whether driving, working at a computer, traveling or other activities, has become a contributing factor to lower back pain, stiffness, and degenerative disk disease. The problem with sitting in a standard single seat chair is that after a few minutes, the pressure of the torso's gravitational weight on the sacrum, the triangular shaped bone between the two iliac bones, begins to lock not only the sacroiliac joint, but also the acetabular joint which houses the femur bone of the leg. Once the sacrum beings to lock, or fixate, at the sacroiliac joints, the lower lumbar spine also beings to immobilize.

The results of this occurrence include the stasis of cerebral spinal fluid in the sacral reservoir of the sacrum, as well as the loss of vital motion of both the ligaments and musculature, therefore causing increased pressure on the lumbar disks. Cerebral spinal fluid originates in the central ventricles of the skull. The fluid is then pumped out of the skull, into the spinal column and down into the sacral reservoir in the center of the sacral bone in the pelvis. The full cycle of the flow of cerebral spinal fluid takes twelve to fifteen seconds. In osteopathy, this cycle is known as the primary respiratory motion.

The mechanism of the pumping of the cerebral spinal fluid is a combination of the movement of the cranial plates in the skull, the intracranial dura mater, and the spinal dura. In order for this entire mechanism to function properly, there must be a return of cerebral spinal fluid (CSF) pumped out of the sacral reservoir. This crucial return of cerebral spinal fluid is contingent on the ability of the sacrum to move in its pitch, roll and yaw range of motion. A decrease or loss of motion of the sacrum leads to inadequate return of CSF back up the spine. Any backup of CSF creates intradural pressure in the lumbar spine, causing the nerve roots to be particularly vulnerable to irritation of inflammation. And, irritation of the lower back nerve roots or ligamentous structures results in compensatory muscle contraction. Based on the premise that the structure of the pelvis influences the function of cerebral spinal fluid flow, it is vital to maintain adequate motion of the structures of the lower spine and pelvis. This necessary mobility will prevent chronic and acute conditions of the lower spine.

Chairs with moving seat elements, which may be motorized or otherwise driven for the purpose of relieving fatigue and simulating some of the hip motion of walking, have been known. Harza U.S. Pat. No. 5,588,704 shows a rocking platform incorporated in a seat, causing one hip to be lifted and then the other in a rhythmic manner while the person is seated. The disclosed apparatus also allows for forward and backward movement of each hip. Harza U.S. Pat. No. 5,022,385 is directed at a similar goal, but using air bags and a pneumatic pump for rocking the two hips up and down in opposition.

Other patents which show power seat mechanisms, but not with the purpose of hip stimulation, include U.S. Pat. Nos. 5,314,238, 5,709,363, 5,735,573 and 5,751,129.

Although the Harza patents cited above show chair mechanisms having moving seat components and directed at some of the purposes of the present invention, none of the above patents contemplates either the efficient mechanism or the type of motion which stem from the present invention.

SUMMARY OF THE INVENTION

The split seat pelvic mobilizing chair of the invention efficiently simulates the hip motion of a user which occurs during walking, thus restoring motion to the hips and preventing fixation of the sacrum and lower lumbar spine. This prevents fatigue and discomfort and assures the continued circulation of the cerebral spinal fluid, thus avoiding the creation of intradural pressure in the lumbar spine as noted above, and resulting inflammation of nerve roots.

The chair seat of the invention does not mimic walking. It does, although to a much lesser degree, move the pelvis in the same type of motion as walking, or allow the pelvis to so move. The object is not to mimic the movement of walking, but rather to keep the pelvis moving in a subtle motion, so the sacrum does not fixate or become immobile. The sacrum is not a weight bearing joint as are the acetabular joints. Although the sacrum supports the spine, the weight of the spine is distributed forward on the sacrum, out through the thick ileo-lumbar ligaments of the fourth and fifth lumbar vertebrae, and into the two iliac bones of the pelvis. The distribution of the weight of the spine and torso allows the sacrum to perform its normal pitch, roll and yaw motion, which enables the cerebral spinal fluid to continuously flow up and down the spine.

The chair seat influences the movement of the structures of the lower spine including the iliac bones, femurs, sacrum and lumbar spine, all of which contribute to the overall integrity of the lower back, and aids the spine's function of moving the body and supporting the individual in a seated as well as standing position. Yet, the movement of the sacrum is crucial for the health and functioning of the enclosed hydraulic fluid system that affects the entire spinal nervous system.

The two primary functions of the apparatus of the invention are (a) to subtly move the two sides of the ilia in alternating, concentric revolutions, to thereby force the pelvis to maintain its motion in coordination with the 12 to 15 second cycle of the cerebral spinal fluid flow, and (b) to allow the sacrum to be suspended in a non-weight bearing position, as a result of the split in the seat support of the apparatus, as a left seat portion or section and a right seat portion or section, separated by a front-to-back cleft line. Only the two sides of the ilia contact the surface of the seat, thus enabling the sacrum to move freely. The preferred movement of each seat portion or seat pad is up, forward, down and then back, in an orbital pattern. This movement is achieved in one preferred embodiment by a cam shaft turned by an electric motor.

The two sides preferably are offset by about 1 mm, providing a difference of 2 mm from the position of one seat section to that of the other. In a specific embodiment one seat portion is always about six seconds behind the other for a total cycle time of about twelve seconds. When one seat portion is up and forward, the other is down and back, i.e. 180° opposite in phase.

In order to save energy, the chair-seat may be fitted with a pressure sensitive switch so that when the person stands up, the seat turns off.

In one preferred embodiment the back stress relieving chair of the invention includes a chair seat supported on a pair of seat platforms, a left platform and right platform, the two platforms being positioned for supporting the respective buttocks of the seated person. Some form of padding may be attached over each platform, to form two discrete seat sections or portions. The apparatus includes means connected to the platforms for stimulating the lower back of the seated person, by simulating the hip motion of walking. The stimulating means preferably include means for causing orbital motion of the two platforms within a vertical front-to-back plane relative to the chair, the orbital motion of the two pads being 180° out of phase.

The split seat, with two discrete seat sections which move in different directions, is a central feature of the invention. In one embodiment the chair can include the two discrete left and right seat sections, without any driving motor. The split seat chair is provided with means for movement of the two seat sections in different directions as the weight of the user is shifted on the chair. The provision of discrete seat sections provides for the sacrum to move freely without contacting the seat surface.

It is thus among the objects of the invention to provide a chair or seat which allows an individual to sit for long periods, whether driving, working behind a desk or engaging in other seated activities, without irritating the lower spine and pelvis. The split seat apparatus helps reduce the degree of strain and discomfort that results from long hours in a single seat chair or car seat. These and other objects, advantages and features of the invention will apparent from the following description of a preferred embodiment, considered along with the accompanying drawings.

DESCRIPTION OF THE DRAWINGS

FIG. 2 is a schematic side elevation view showing a portion of the human skeletal structure and indicating movable platforms of the invention which are within the split chair seat for causing hip motion while seated.

FIG. 3 is a front elevation view, again schematically indicating a portion of the human skeletal structure, and indicating the two seat platforms of the chair, which cause or allow motion of the hips.

FIGS. 8 and 9 are schematic side elevation and plan views showing another embodiment of a pelvic motion apparatus for incorporation in a seat.

DESCRIPTION OF PREFERRED EMBODIMENTS

Figure 1:
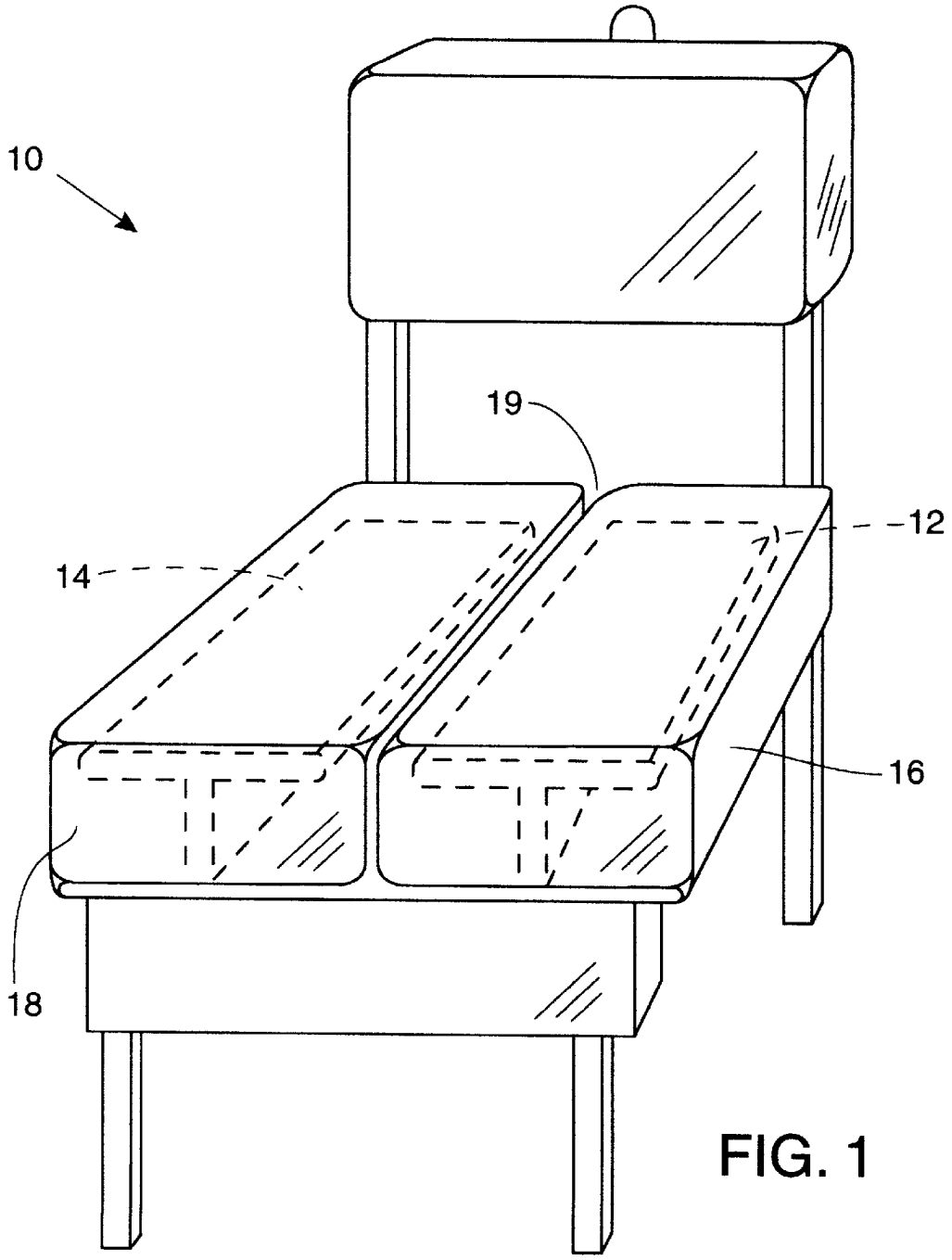
FIG. 1 is a perspective view showing a split seat chair according to the invention, incorporating a mechanism for moving the hips while seated.

The ergonomic chair seat of the invention is an automated movable split chair seat that initiates the movement of the two iliac bones of the pelvis to move naturally by alternately rotating each side in a preferably concentric circular motion, or in a non-circular orbital motion. FIG. 1 shows the chair 10 and indicates, in dashed lines, left and right seat platforms 12 and 14 hidden within or beneath left and right seat sections or portions or halves 16 and 18 that are separated by a longitudinal cleft line or plane 19. The desired movement is achieved by each of the two sides of the split seat 16, 18 supporting the two separate iliac bones that make up the pelvis.

The two seat portions or sections 16 and 18, as discrete and separate seat elements which move separately, comprise the preferred form of the seat. These sections can include padding over the platform 12 and 14. However, in a variation the two underlying seat platforms 12 and 14 can be positioned within a single, undivided seat cushion which has sufficient flexibility within its top cushioning region that the pads 12 and 14 can move the pelvic bones in the desired pattern of motion to the extent that the user experiences the same motion as with the split seat.

FIGS. 2 and 3 schematically indicate the motion imparted to the pelvis when a person is seated in the chair. FIG. 2 shows a portion 20 of a human skeletal structure and indicating generally the motion imparted to the two sides of the pelvis. The pelvis is shown at 22, including left and right sides or ilia 22*a* and 22*b*. Although the motion-indicating arrows 24 of FIG. 2 are exaggerated as to the range of motion, they indicate a clockwise pattern of orbital rotation of the right hip as viewed from the right side of the person and of the chair. At the same time, the left hip or ilium 22*a* moves in a similar clockwise orbital rotation, but 180° out of phase with the right ilium 22*b*. FIG. 3 demonstrates this out-of-phase relationship, at least with respect to the height differential of the two platforms 12 and 14 and the opposite motion of the two hips, up on the left and down on the right, for a particular point in the cycle. As FIG. 3 indicates, this causes the lower spine 26 to tilt or curve to the seated person's right at this particular point in the cycle. In one preferred embodiment the motion is circular and has a maximum total displacement of about 2 mm, i.e. the distance from maximum up to maximum down and from maximum forward to maximum back. More broadly, the total displacement should be at least about 2 mm and at most about 8 mm; or more specifically, about 2 mm to about 4 mm. If more padding is used over the seat platforms 12 and 14, this generally tends toward use of greater range of motion (displacement) of the platforms, beyond the 2 mm discussed above.

The described motion of the two ilia, in opposition to one another, provides a pattern of motion in the hips which roughly simulates the motion of walking, although at a much smaller amplitude of movement. This contrasts with movement stimulating chairs of the prior art, wherein the motions were generally simpler and not similar to the hip motions of walking.

Most of the primary objective of the invention can be achieved with a split-seat chair in which the two seat sections are movable to accommodate shifting of the hips, with the two sections confined to a range of movement, even if the two seat sections are not driven in their movement by a motor. The benefits of the split-seat chair are still primarily achieved, with the sacrum between the seat sections and not in contact with the seat, and with the two ilia capable of moving up or down in opposition to one another and/or forward and back in opposition to one another, simply by their own shifting and not under the influence of a driving motor, as explained further below.

Figure 4:
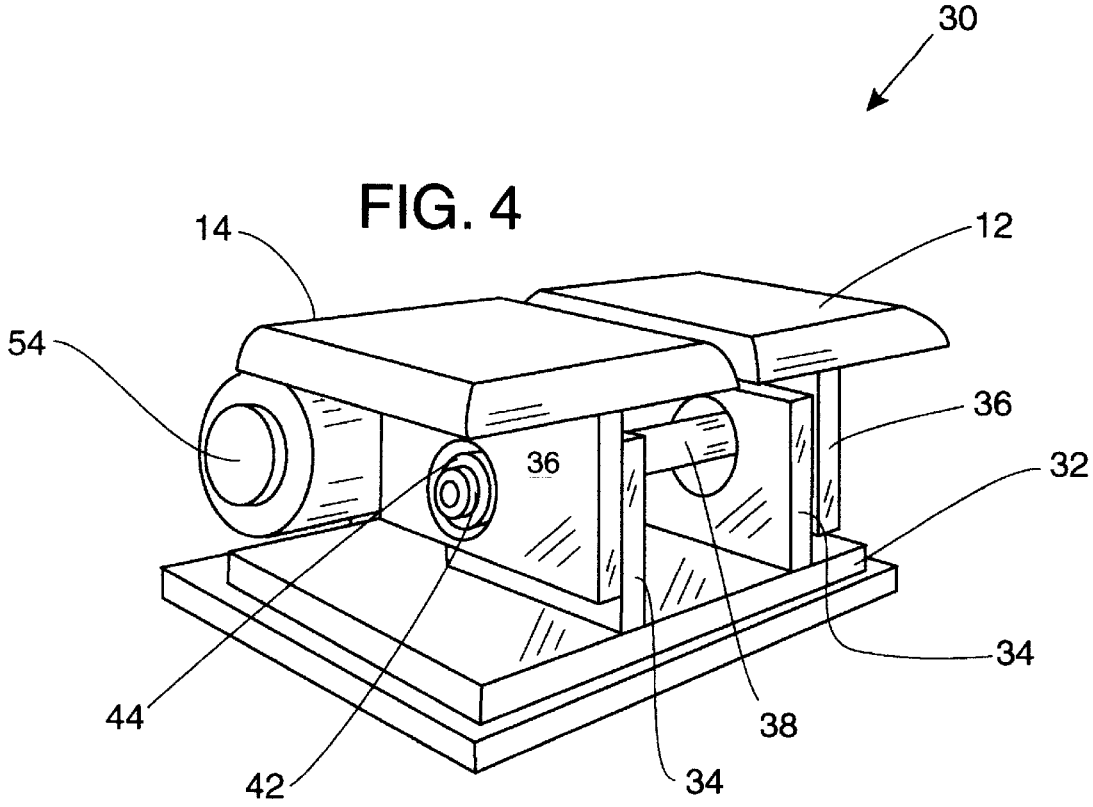
FIGS. 4, 5, 6 and 7 are perspective views from front left, front, rear left and rear of a mechanism which provides the hip stimulating motion in accordance with one preferred embodiment of the invention.

FIGS. 4–7 show a mechanical apparatus 30 embodying one preferred form of the invention, for incorporation in a chair or seat to provide the desired stimulating motion. FIG. 4 reveals the mechanism 30 from its front side, the apparatus including a base 32, a pair of spaced upright plates or frame members 34 which are rigidly affixed to the base, and the seat plates or platforms 12 and 14 which form the split seat, each plate having a rigidly attached depending perpendicular seat platform base 36 comprising a flange or stem as shown, each being directly alongside one of the uprights 34. The seat platforms or plates 12, 14 are thus attached to a cam shaft 38 which is anchored to the base 32 via the upright frame pieces 34. These components preferably are light in weight; the seat base 32 can be made of ⅜ inch lightweight aluminum, or ½ inch plastic, approximately 10 inches deep by about 11 inches wide. These dimensions will vary as to the size of the chair, car seat or other seat into which they are incorporated. The upright plates or frame pieces 34 can also be formed of ⅜ inch lightweight aluminum. The two uprights 34 may be about 4 inches apart, each housing a ball bearing (not seen in the drawings) that allows the cam shaft 38, which may be ¾ inch in diameter, to be supported in the uprights 34. After the cam shaft 38 is fit through the upright plates 34, offset shafts 40 and 42 are attached, on each end of the cam shaft, which can be by machine screws. These offset shafts or eccentric drive components are, in one specific embodiment, each one millimeter offset from the shaft 38, and 180° opposed from one another in their offset positions. The seat extension bases or flanges 36 each also house a ball bearing 44, as indicated in FIGS. 4–7, in order to facilitate the motion of the seat plates via the motion of the eccentric drive offset shafts 40 and 42.

The two seat plates 12 and 14, each of which can be covered with foam rubber or resilient material and/or fabric, are thus each offset on respective ends of the cam shaft by about 1 millimeter, making a 2 millimeter difference between the seat plate positions (up/down, forward/back, or obliquely, depending on position in the cycle).

In the preferred embodiment illustrated, the cam shaft is driven by gears or by a belt. Thus, the drawings show a drive pulley or timing gear type element 48 on the shaft 38, driven by a belt which may be a timing belt 50 as shown in FIG. 6, engaged also around a driving pulley or timing gear 52 (belt not shown in FIG. 5). An ordinary V-belt and V-pulleys, a chain and sprockets, or meshed gears could also be used. In one specific embodiment, the pulley or timing gear 52 on the driving end is connected to a Dayton Model 4Z534A permanent magnet DC 1/30 HP, 7 RPM motor 54. The motor 54 is fitted with a built-on gear reduction box 56, providing the 7 RPM output. The motor is also connected to a rheostat 58 which can be a Dayton Model 6A191 speed control, with a speed selector dial 60, and the device 58 may also include a rectifier for AC to DC current. A smaller, lower h.p. motor may be used if desired, since very little power is required to produce the motion described. For example, motors of the types used for adjustable automotive car seats and windows could be used, with appropriate gearing.

The entire seat mechanism 30 in one preferred embodiment is about 2¾ inch in height from the bottom of the base 32 to the top of the split seat platforms 12, 14. The seat mechanism or the chair seat sections 16, 18, preferably are fitted with a pressure sensitive switch (not shown) so that the motor 54 shuts off when not in use. The unit 30 can efficiently be incorporated in a chair, vehicle seat, work bench or other seating apparatus, including as an original item of manufacture, such as by incorporation in an automotive seat by the manufacturer. In an automobile the device can be connected to the DC battery, thus eliminating the need for rectifying AC current.

Figure 5:
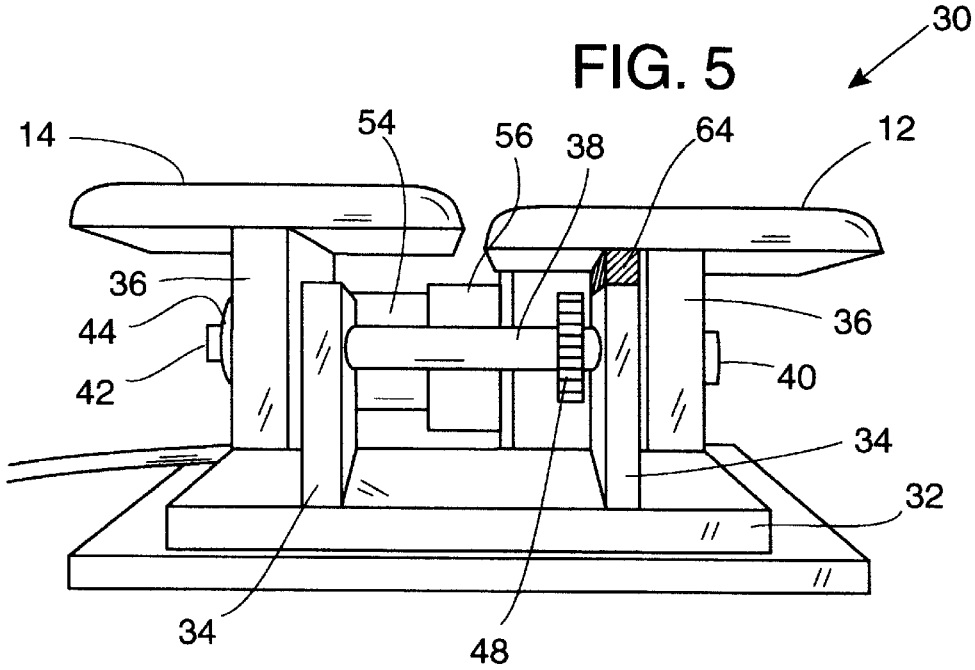
Figure 6:
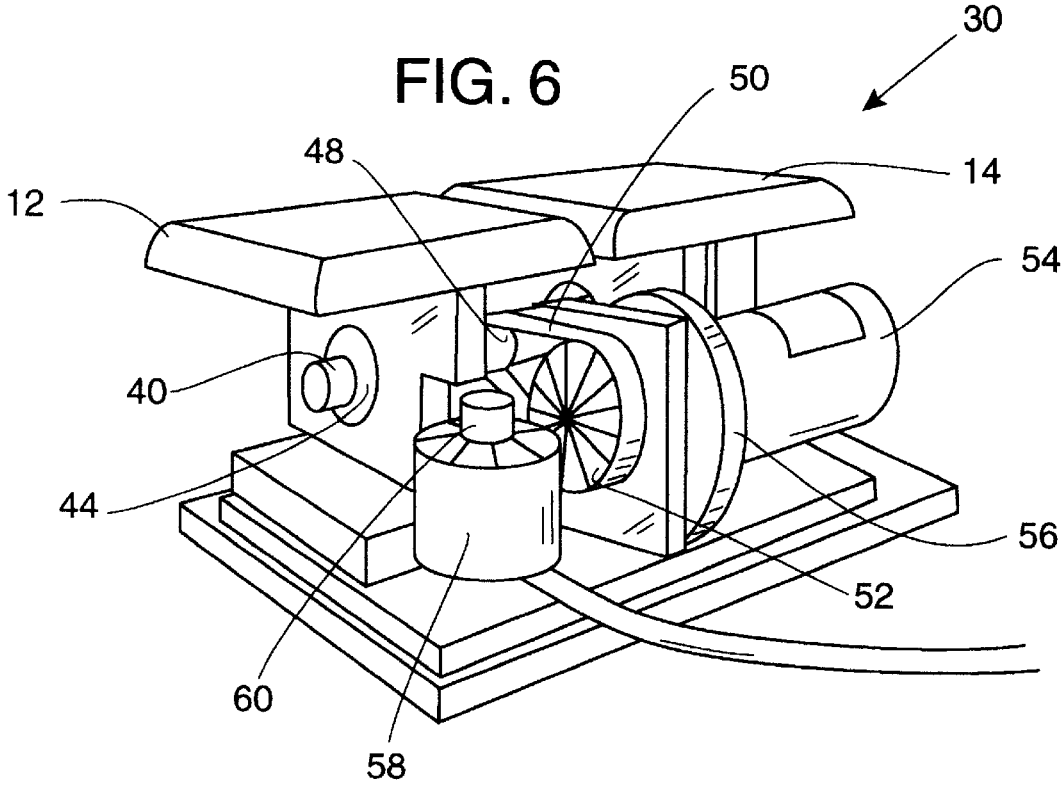
Figure 7:
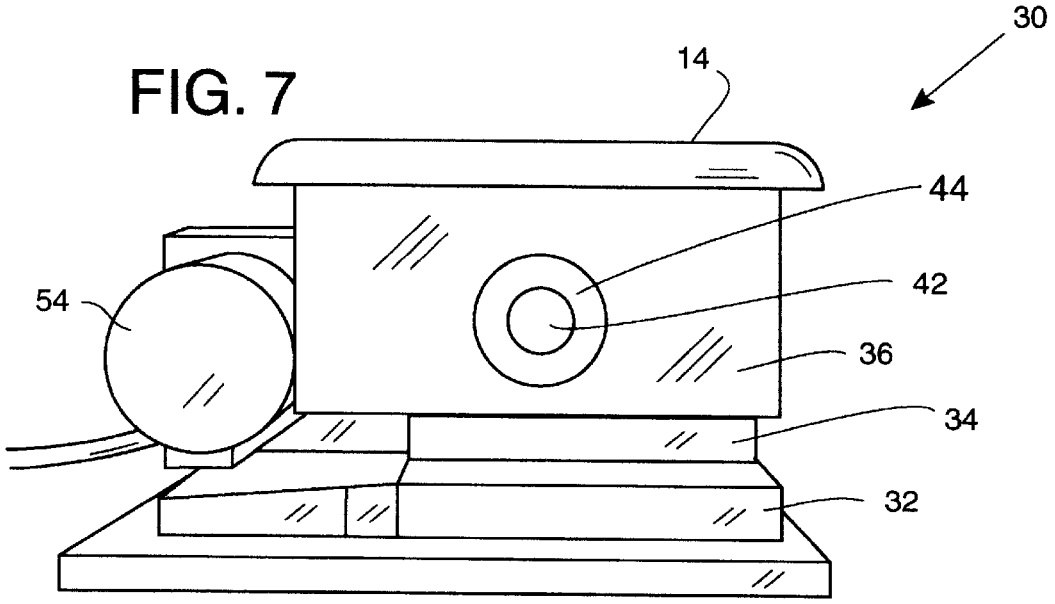

In the preferred form of the mechanism 30 illustrated shown in FIGS. 4–7, the left and right seat plates or platforms 12 and 14 are connected to the remainder of the mechanism only via the connection to the eccentric drive shaft ends 40, 42, as well as by close proximity of the vertical plate base members 36 to the vertical, fixed uprights 34 from the base 32. This simple arrangement, advantageous for its simplicity, tends to leave the seat plates 12, 14 free to rock forward and back, as can be seen from the drawings. Some such rocking motion is desirable, allowing the platforms to tip back or forward with movements of the user. To reduce this motion and make it smoother, a foam rubber pad 64 preferably is fitted between the bottom of each seat plate 12 and the top of the adjacent upright support 34, as shown in FIG. 5 under the seat plate 12 (the foam rubber pad is omitted from the other side of the mechanism for clarity in the drawings). In one specific embodiment the maximum space between the plate 12, 14 and the top of the adjacent upright 34 during the cycle is about 3/16 inch, which would only allow a small amount of rocking in any event, and this space is filled by the foam rubber pad 64, somewhat compressed. The minimum spacing between plate and upright in this embodiment is about ⅛ inch, at which position the foam rubber pad 64 is tightly compressed.

The mechanism of the illustrated embodiment of FIGS. 4–7 thus maintains a smooth, steady motion that forces the two ilia of the pelvis to rotate subtly in the same direction but in opposition to each other, alternately up, forward, down and back, while the user is seated. The rotation in this way prevents decreased mobility and reduced function of the lower back due to long periods in a seated posture.

In one preferred mode of operation of the apparatus of the invention, the cam shaft revolves approximately once per 12 seconds, which is coordinated with the flow of cerebrospinal fluid in the skull as it travels down into the sacrum as discussed above. The ultimate goal of the chair apparatus is to move the pelvis in a gliding motion while the individual is seated on a chair or seat, thus reducing posturally caused lower back pain and stiffness.

It should be understood that mechanisms other than the device 30 can be employed to generate the motion of the split seat as described. Whatever driven mechanism is used, it is important that it generate a substantially orbital motion, whether circular-orbital or elliptical-orbital, so that the buttocks and hips are moved in generally circular or elliptical paths in opposition to one another, in a small range of motion, such as about 1 to 4 mm from a center, so that the desired hip motion stimulation is achieved in a smooth and subtle manner.

As mentioned above, in a variation of the invention the split seat is not motor driven but still facilitates a similar motion of the pelvis in a guided pattern, such that the two ilia can move simultaneously in different directions of movement. In one preferred form this movement is guided by some mechanical means, so as to guide the two seat plates in opposing movement to one another, but the apparatus can take other forms as well. For example, one form of such a split seat chair device for stimulating therapeutic hip movement is shown schematically in FIGS. 8 and 9.

FIG. 8 shows in side elevation view a simulating device 70 with a base 72 and left and right seat platforms 74, only one of which is seen in FIG. 8. The plan view of FIG. 9 shows in dashed lines these two seat platforms, which may be separated a small distance such as about ⅜ inch. In this embodiment flexible rubber balls 76 permit motion of the seat platforms 74 when the seated person shifts and moves. These rubber balls, for example, can be about ¾ inch in diameter and placed in three rows 78, 80 and 82 under each seat platform in anterior, middle and posterior positions as shown. This arrangement allows each seat platform 74 to move independently and opposite of the other, including up/down and forward to back tipping. If a person sitting on the seat turns to reach for something to the left, for example, the left seat platform will see-saw up in front and down in back, while the right seat platform see-saws forward and down in the front. This allows the pelvis to move accommodatingly as the person shifts. The illustrated arrangement allows a certain amount of sliding movement as well due to the resilience of the balls 76. When one side of the pelvis moves forward, as when the person shifts a leg forward, then that seat platform moves forward to some extent, while the opposite seat platform slides back. The total movement of each platform in the sliding direction may be about ¼ inch to ½ inch.

The balls 76 may be confined in their respective rows by appropriate means such as adhesives or mechanical connections. Adhesives are preferred. FIG. 8 shows that the balls in the center row 80 may be raised by rigid spacers 84 (e.g. ¼" thick), while the balls of the front and back rows 78 and 82 may have compressible foam strips 86 between top sides and the platform above. The foam strips 86 add to the displacement capability of the platforms in tipping and can be selected for firmness. Preferably adhesives hold all of these components together.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A seat apparatus for helping relieve lower back pain and stiffness while seated, said apparatus comprising:

a base of the seat apparatus, a split seat comprising two separate and discrete seat sections side by side, supported on a pair of respective seat platforms including a left platform and a right platform, the two seat sections being positioned for supporting the respective buttocks of the seated person, and means connected to the platforms and to the base for stimulating the lower back of the seated person, by causing orbital motion of the two platforms generally about horizontal axes lateral to the seat apparatus, the orbital motion of the two platforms being in the same orbital direction and out of phase from one another.

2. The seat apparatus of claim 1, wherein the two platforms are substantially 180° opposed in their orbital motion.

3. The seat apparatus of claim 2, wherein said means for causing orbital motion comprises a single shaft defining an axis which comprises said axes of rotation, a seat platform base affixed to each of said seat platforms, means for generally guiding the motion of the seat platforms during orbital motion, two eccentric drive components on the shaft, one connected to each of the seat platform bases and being essentially 180°-opposed in position so that when one eccentric drive component moves a seat platform up the other eccentric drive component moves the other seat platform down, and motor means secured to the base of the seat apparatus for rotating the shaft at a preselected speed.

4. The seat apparatus of claim 3, wherein the means for guiding the motion of the seat platforms comprises the seat platforms each having a bottom surface, the fixed mechanism base having a pair of uprights, each having an upper edge closely adjacent to the bottom surface of the respective seat platform, and a rubbery, compressible elastomeric material between the bottom of the seat platform and the top edge of the upright.

5. A seat apparatus for helping relieve lower back pain and stiffness while seated in the seat apparatus, said apparatus comprising:

a split seat comprising two separate and discrete seat sections side by side such that one of the seat sections is positioned to be under a left buttock of a seated user and the other seat section is positioned to be under the right buttock of the user, the two seat sections being supported on a pair of respective seat platforms, means connected to the seat platforms for allowing motion of the two ilia of the seated user's pelvis generally in opposition to one another, such that as one seat platform descends with one ilium of the user, the other seat platform rises with the other ilium of the user, and including drive means for moving the two platforms in generally orbital motion, the orbital motion being in a generally vertical forward-to-back plane relative to the seat platform and the positions of the two platforms being essentially 180° out of phase from one another within the orbital motion.

6. The seat apparatus of claim 5, wherein the maximum displacement between the two seat platforms within the orbital motion is between about 2 millimeters and 8 millimeters.

7. The seat apparatus of claim 6, wherein said maximum displacement is about 2 millimeters.

8. The seat apparatus of claim 6, wherein the speed of movement of the seat platforms is about one cycle per 12 seconds.

* * * * *